US011401155B1

(12) United States Patent
van Sloten et al.

(10) Patent No.: US 11,401,155 B1
(45) Date of Patent: Aug. 2, 2022

(54) SYSTEM FOR TRANSFERRING CRUDE OIL FROM AN ONSHORE LOCATION TO A VESSEL

(71) Applicant: BLUEWATER ENERGY SERVICES B.V., Hoofddorp (NL)

(72) Inventors: Peter Nicolaas van Sloten, Voorhout (NL); Clemens Gerardus Johannes Maria van der Nat, The Hague (NL); Roland Wilhelmus van der Zande, Hillegom (NL)

(73) Assignee: BLUEWATER ENERGY SERVICES B.V., Hoofddorp (NL)

( * ) Notice: Subject to any disclaimer, the term of this patent is extended or adjusted under 35 U.S.C. 154(b) by 0 days.

(21) Appl. No.: 17/313,843

(22) Filed: May 6, 2021

(51) Int. Cl.
*B67D 9/00* (2010.01)
*B63B 27/00* (2006.01)
*B63B 27/25* (2006.01)

(52) U.S. Cl.
CPC ..... *B67D 9/00* (2013.01); *B63B 27/25* (2013.01); *B63B 27/29* (2020.05)

(58) Field of Classification Search
CPC ..... B67D 9/00; B63B 27/25; B63B 27/29
USPC ..... 114/267
See application file for complete search history.

(56) References Cited

U.S. PATENT DOCUMENTS 3,016,928 A * 1/1962 Brandt ..... B67D 7/0482 141/45
3,969,781 A * 7/1976 Reid, Jr. ..... B63B 22/021 441/5
4,256,151 A * 3/1981 Gunn ..... B67D 7/048 141/206
4,260,000 A * 4/1981 McGahey ..... B67D 7/048 141/286
4,315,408 A * 2/1982 Karl ..... F16L 11/22 138/107
4,469,143 A * 9/1984 Vazin ..... B08B 9/08 134/10
5,186,577 A * 2/1993 Reicin ..... B65D 90/105 137/312
5,301,721 A * 4/1994 Hartmann ..... B67D 7/0478 137/312
5,567,126 A * 10/1996 Meece ..... B67D 7/048 141/1
6,415,828 B1 * 7/2002 Duggal ..... B63B 22/021 141/279
7,438,617 B2 * 10/2008 Poldervaart ..... B63B 22/021 441/5
7,666,044 B2 * 2/2010 Wille ..... F16L 1/12 441/4
7,750,494 B1 * 7/2010 Behrens ..... F03D 3/005 290/55

(Continued)

*Primary Examiner* — Timothy L Maust
(74) *Attorney, Agent, or Firm* — Steven M. Koehler; Westman, Champlin & Koehler, P.A.

(57) ABSTRACT

A system for transferring crude oil from an onshore location to an offshore vessel comprises a crude oil supply assembly for transferring the crude oil from an onshore oil supply to the vessel, and a vapor return assembly for transferring vapor from the vessel to a vapor processing facility. The vapor return assembly is provided with a fan configured to promote a flow of vapor through the vapor return assembly from the vessel towards the vapor processing facility. The system further is provided with a member for energizing the fan.

13 Claims, 3 Drawing Sheets

(56) References Cited

U.S. PATENT DOCUMENTS

| | | | | |
|---|---|---|---|---|
| 7,975,769 | B2 * | 7/2011 | Pollack | B63B 35/4413 166/350 |
| 8,148,840 | B2 * | 4/2012 | Gradle | A01G 15/00 290/53 |
| 8,405,242 | B2 * | 3/2013 | Borden | C25B 9/73 290/55 |
| 2008/0245286 | A1 * | 10/2008 | Adamo | B63B 35/44 114/267 |
| 2009/0309366 | A1 * | 12/2009 | Moore | F03B 13/1845 290/53 |
| 2013/0101356 | A1 * | 4/2013 | Newcomer | B63B 35/44 405/195.1 |
| 2014/0261132 | A1 * | 9/2014 | Zeren | C01F 1/00 114/257 |
| 2016/0059938 | A1 * | 3/2016 | Momayez | B63B 35/50 440/6 |

* cited by examiner

SYSTEM FOR TRANSFERRING CRUDE OIL FROM AN ONSHORE LOCATION TO A VESSEL

BACKGROUND

The discussion below is merely provided for general back-ground information and is not intended to be used as an aid in determining the scope of the claimed subject matter.

The invention relates to a system for vapor control while transferring crude oil from an onshore location to a vessel or tanker (such as crude carriers/oil tankers) located offshore and moored to a buoy. The purpose of the system is to load such vessels. During loading the vessel with the crude oil, vapor within the vessel's cargo tanks is pushed out. This vapor can be discharged directly to the environment through cargo tank vent valves, but nowadays there is an increasing demand for systems in which the vapor pushed out is directed to a vapor processing facility at which the vapor in some manner is processed in an environmentally friendly manner (or re-used, for example as blanketing gas in an onshore storage facility).

It is noted that, although the invention is described with respect to the transfer of crude oil, the invention also can relate to the transfer of another substance, such as for example LPG, ethylene, liquefied $CO_2$ and ammonia. Likewise, the term 'buoy' also intends to cover a tower-based SPM as well.

In such a system the vapor will be fed through a vapor return assembly. Due to the extension of the vapor return assembly between the vessel and the vapor processing facility, which in many instances will be substantial, the vapor flow through the vapor return assembly will be subjected to a considerable flow resistance which may have an adverse effect on the vapor removal capacity of the system.

SUMMARY

This Summary and Abstract are provided herein to introduce a selection of concepts in simplified form that are further described below in the Detailed Description. The Summary and Abstract are not intended to identify key features or essential features of the claimed subject matter, nor are they intended to be used as an aid in determining the scope of the claimed subject matter. The claimed subject matter is not limited to the implementations that solve any or all of the disadvantages noted in the background.

An aspect of the present invention is a system for transferring crude oil from an onshore location to an offshore vessel comprising a buoy, a crude oil supply assembly comprising a buoy oil piping on the buoy, at least one oil hose having a first end connected to the buoy oil piping and an opposite second end configured to be connected to the vessel, at least one oil conduit assembly having a first end configured to be connected to an onshore oil supply and an opposite second end connected to the buoy oil piping, and a vapor return assembly comprising a buoy vapor piping on the buoy, at least one vapor hose having a first end connected to the buoy vapor piping and an opposite second end configured to be connected to the vessel, at least one vapor conduit assembly having a first end configured to be connected to a vapor processing facility and an opposite second end connected to the buoy vapor piping, wherein the vapor return assembly is provided with a fan configured to promote a flow of vapor through the vapor return assembly from the vessel towards the vapor processing facility and wherein the system further is provided with a member for energizing the fan.

It is noted that the indication 'fan' also intends to cover equivalent members, such as a blower or compressor.

The use of a fan in the vapor return assembly promotes the vapor flow out of the vessel and through the vapor return assembly. As a result, an effective removal of the vapor from the vessel is effected while the risk of vapor escaping to the surroundings is minimized.

In one aspect of the invention the fan is provided in the buoy vapor piping, thus on the buoy.

In one aspect of the invention the fan is an electric fan and wherein the member for energizing the fan is configured as an electric cable connected to a source of electric power.

The source of electric power may be an onshore power source, but in another aspect of the invention the source of electric power is a buoy supported power source, such as at least one of, or any combination of, a solar panel, a battery, and a wind turbine.

In one aspect of the invention the member for energizing the fan is configured as a turbine provided in the crude oil supply assembly and drivingly connected to the fan.

The provision of such a turbine (which also could be indicated as a pump) allows to make the operation of the fan depending on the magnitude of flow of crude oil towards the vessel. An increase of the flow automatically will lead to an increased flow of vapor out of the vessel, which is taken care of by an increased output of the turbine and thus an increased speed of the fan.

The relation between the output of the turbine and the speed of the fan may be subjected to the operation of a control member (and, for example, not necessarily has to be linear).

In another aspect of the invention the turbine is drivingly connected to the fan by means of one of a mechanical shaft, a hydraulic connection, a pneumatic connection or by means of an electric assembly comprising an electric generator connected to the turbine and an electric motor for driving the fan, wherein in the latter case the electric generator may be integrated into the turbine.

In one aspect of the invention the turbine is provided in the buoy oil piping.

In another aspect the oil hose is a floating oil hose and wherein the vapor hose is a floating vapor hose.

In yet another aspect the oil conduit assembly comprises a subsea pipe-line end manifold (PLEM), at least one subsea oil hose having a first end connected to the PLEM and an opposite second end connected to the buoy piping, at least one subsea oil pipeline having a first end configured to be connected to the onshore oil supply and a second end supported by the PLEM and, directly or indirectly, connected to the first end of the at least one subsea oil hose, and wherein the vapor conduit assembly comprises an additional subsea pipe-line end manifold (PLEM), at least one subsea vapor hose having a first end connected to the additional PLEM and an opposite second end connected to the buoy piping, at least one subsea vapor pipeline having a first end configured to be connected to the vapor processing facility and a second end supported by the additional PLEM and, directly or indirectly, connected to the first end of the at least one subsea vapor hose.

The PLEM and additional PLEM may be combined into a single PLEM.

The system, in another aspect of the invention, further comprises a drain operatively connected to at least one of the floating vapor hose, buoy piping, subsea vapor hose and subsea vapor pipeline and configured to remove condensed vapor therefrom.

It is noted that although the term 'condensed vapor' is used, this should be interpreted throughout this application as any liquid drop out from the vapor, also if not resulting from condensation.

Using the drain, condensed vapor that accumulates in one of the floating vapor hose, buoy piping, subsea vapor hose and subsea vapor pipeline may be removed, thus preventing that such accumulated vapor will block any of these parts and thus would prevent the system from functioning in a correct manner (such accumulations also could increase the flow resistance). In one embodiment the floating vapor hose in the region of its first end defines a collecting hose part located at a lower level than opposite adjoining parts of the floating vapor hose and wherein a drain is provided for draining condensed vapor which has collected at said collecting hose part. As a result of being located at said lower level the collecting hose part effectively collects any liquid drop out, which then can be drained therefrom.

It is noted that the concept of the invention also relates to systems in which any of the mentioned components (for example the hoses or pipelines) are provided in a larger number than described in this application.

BRIEF DESCRIPTION OF THE DRAWINGS

Hereinafter aspects of the invention will be elucidated while referring to the drawings, in which.

DETAILED DESCRIPTION

Figure 1:
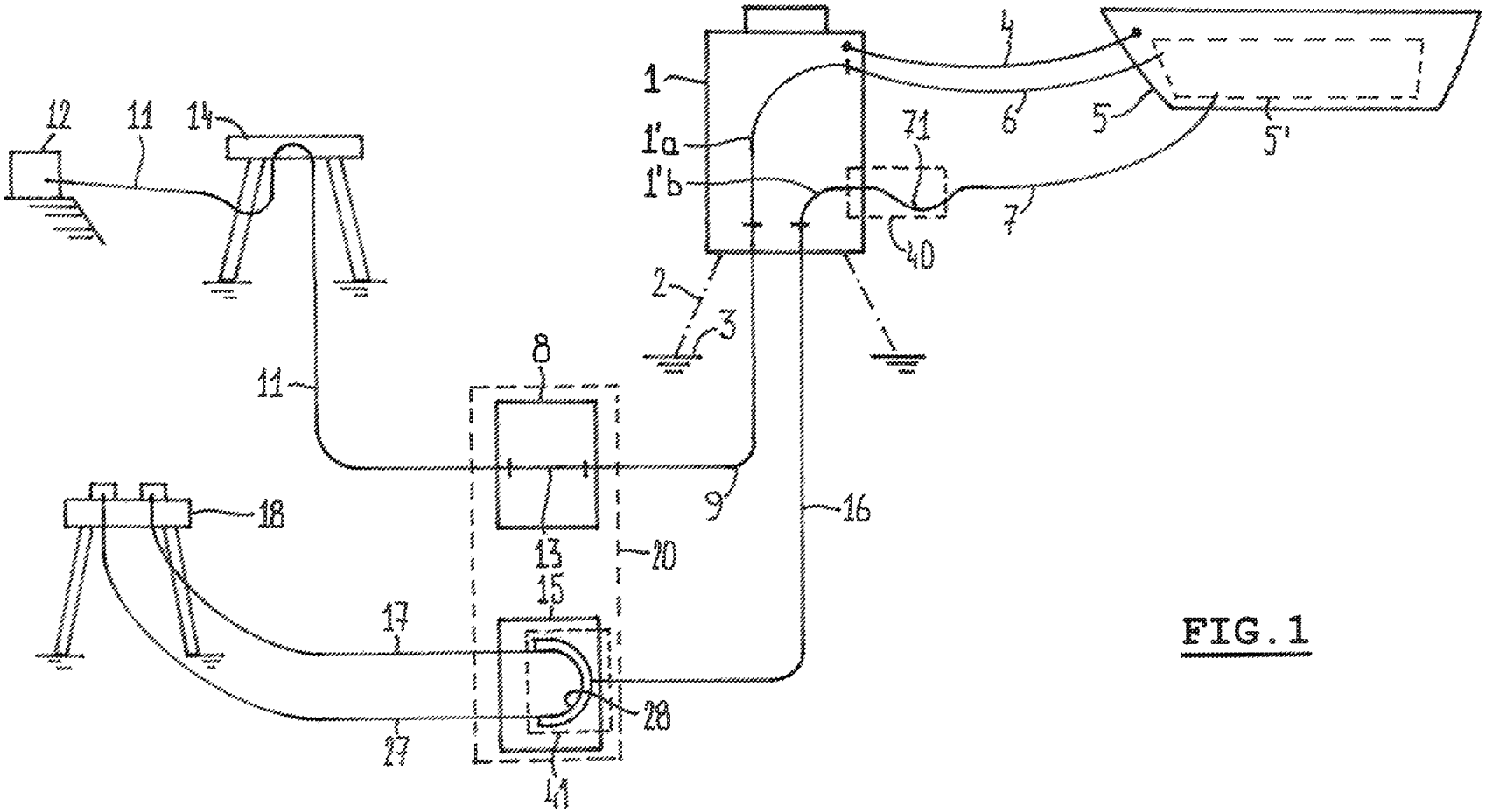
FIG. 1 shows a schematic representation of a system for transferring crude oil from an onshore location to an offshore vessel providing a vapor return.

In FIG. 1 a schematic representation is shown of a system for transferring crude oil from an onshore location to an offshore vessel providing a vapor return. It is noted that, although the following description of such a system and its details refers to the transfer of crude oil, the system according to the present invention also could be used for transferring other substances, such as for example gas or liquefied gas without departing from the scope of the invention. Further it is noted that the use of 'subsea' with connection to types of hoses does not exclude the possibility that part(s) of such hoses are located at or above sea level.

Firstly, the system comprises a buoy 1 with buoy oil piping 1'*a* and buoy vapor piping 1'*b*, which buoy by means of mooring lines 2 may be moored to the seabed 3. Provisions may be made that the buoy, or part thereof, may weathervane. The buoy 1 carries a hawser 4 which can be picked up by an arriving vessel 5 (such as a crude carrier/oil tanker) to be attached (for example) to the bow of the vessel 5 for mooring the vessel to the buoy 1. Between the buoy 1 and the vessel 5 a floating oil hose 6 extends having a first end supported by the buoy 1 and an opposite second end configured to be connected to the vessel 5 (for example to specific manifolds, ports or valves offering access to a cargo tank 5' of the vessel). The manner in which such a connection can be established may vary and is not part of the invention. After connection the crude oil (or other substance) may be pumped into the cargo tank 5' of the vessel 5 through the floating oil hose 6.

Figure 2:
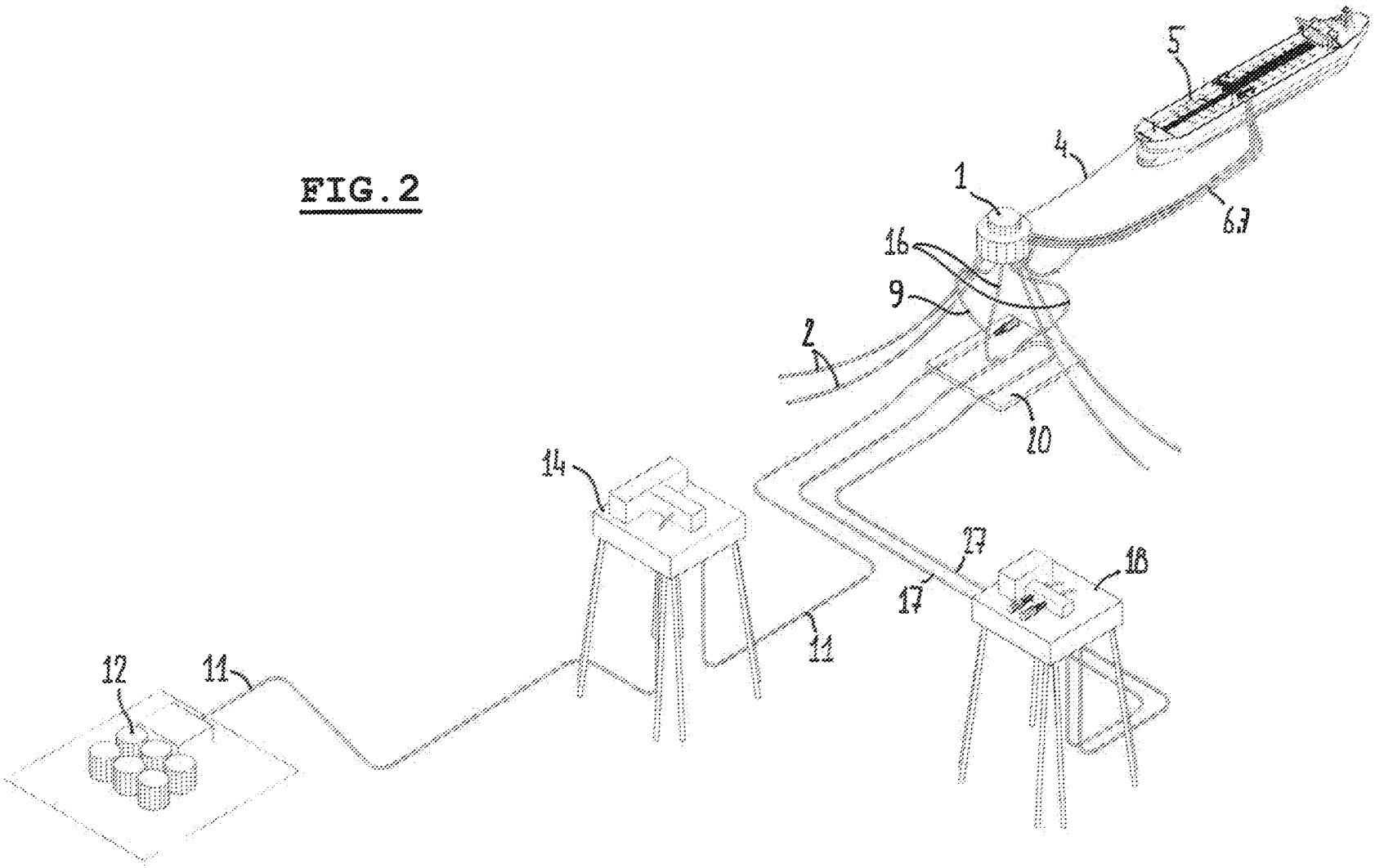
FIG. 2 shows a schematic perspective illustration of the system.

Further at least one (as illustrated in FIG. 2) floating vapor hose 7 is provided which likewise extends between the buoy 1 and the cargo tank 5' of the vessel 5 and which has a first end supported by the buoy 1 and an opposite second end configured to be connected to the vessel. After connection, the floating vapor hose 7 communicates with the top of the cargo tank 5' (specifically with vent holes thereof not represented here) and is capable of discharging vapor (typically a gas with low oxygen content and water vapor generated by the tanker inert gas system, for example (a mixture of) nitrogen, CO, $CO_2$, some $O_2$ and some methane or other volatile hydrocarbons or water vapor) which is pushed out of the cargo tank when the crude oil enters the latter.

The system, in the illustrated embodiment, further comprises a subsea pipe-line end manifold (hereafter called PLEM) 8 which generally will be located on the seabed 3. A subsea oil hose 9 extends between said PLEM 8 and an opposite second end supported by the buoy 1, which directly or indirectly (for example through the buoy oil piping 1'*a*), is connected to the (first end of the) floating oil hose 6. The buoy oil piping 1'*a* (but also the buoy vapor piping 1'*b*) may comprise or may cooperate with additional components of the buoy, such as, for example, manifolds or swivels (as is known per se).

A subsea oil pipeline 11 is provided which extends between the PLEM 8 and an onshore oil supply 12 and has a first end configured to be connected to said onshore oil supply 12 (or any other feature for supplying oil, such as, for example, a pumping unit) and a second end supported by the PLEM 8 and, directly or indirectly, connected to the (first end of the) subsea oil hose 9. Again, such a connection preferably will occur indirectly, for example through piping 13 which is part of the PLEM 8, and which may comprise additional components, such as for example a manifold (not represented).

The subsea oil pipeline 11 may be routed along additional members, such as for example a pumping platform 14. For understanding the present invention, the features and function of such additional members are not relevant and thus will not be elucidated further here.

As a further component the system comprises another subsea pipe-line end manifold (hereafter called additional PLEM) 15 which also generally will be located on the seabed 3. A subsea vapor hose 16 is provided having a first end supported by the additional PLEM 15 and an opposite second end supported by the buoy 1 and, directly or indirectly (for example through the buoy vapor piping 1'*b*), connected to the (first end of the) floating vapor hose 7.

Further, in this embodiment, two subsea vapor pipelines 17 and 27 are provided each having a first end configured to be connected to a vapor processing facility or platform 18 (the details of which are not relevant for understanding the present invention) and a second end supported by the additional PLEM 15 and, directly or indirectly, connected to the (first end of the) subsea vapor hose 16. Said connection preferably will be indirect through piping which is part of the additional PLEM 15.

It is possible that the PLEM 8 and additional PLEM 15 are combined into a single PLEM (indicated schematically at 20).

It also is conceivable that the platforms 14 and 18 are combined into a single platform (and also may be located onshore).

The system further comprises means for the removal of condensed vapor from at least one of the floating vapor hose 7, buoy vapor piping 1'*b*, subsea vapor hose 16 and subsea vapor pipelines 17 and 27. Embodiments of such means are represented schematically at 40 (representing a means for removing condensed vapor from a collecting loop 71 of the floating vapor hose 7) and/or at 41 (representing a means for removing condensed vapor from a collecting loop 28 between the two subsea vapor pipelines 17 and 27).

Referring to FIG. 2, the system is illustrated in a schematic perspective view. Among others it shows the buoy 1 and the vessel 5 moored to the buoy through the hawser 4. Further the separate or multiple floating oil hoses 6 and floating vapor hose 7 are assembled to a bundle.

A combined PLEM 20 is illustrated. Further one can see the subsea oil hoses 9 connecting (via the PLEM) to the subsea oil pipeline 11 which (via platform 14) is connected to the onshore oil supply 12.

FIG. 2 further shows two subsea vapor hoses 16 which, through the PLEM 20, are connected to the subsea vapor pipelines 17,27 which lead to the vapor processing facility 18.

Some components of the system, while being illustrated as a single component, also could be provided in larger numbers (such as illustrated in FIG. 2 for the subsea vapor hoses 16). For example, multiple floating oil hoses 6, floating vapor hoses 7, subsea oil hoses 9 or subsea oil pipelines 11 may be provided too. The use of more than one buoy 1 is another option (for example for use with more vessels 5 simultaneously). The specific configuration of the system will depend on the relevant circumstances, but the basic design will be as illustrated in, or can easily be derived from FIG. 1.

Figure 3:
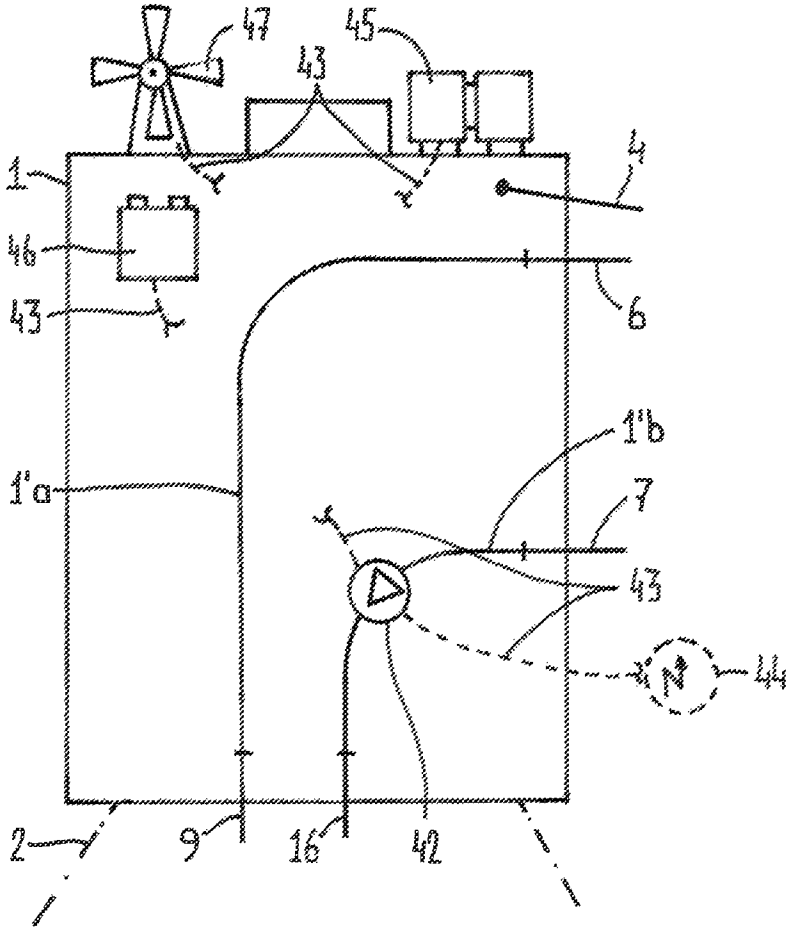
FIG. 3 shows a schematic representation of an embodiment of a buoy of the system, and FIG. 4 in a similar manner shows an alternative embodiment of a buoy of the system.

FIG. 3 shows an embodiment of the buoy 1 of the system on a larger scale. As illustrated, the buoy vapor piping 1'*b* is provided with a fan 42 configured to promote a flow of vapor through the components of the vapor return assembly (comprising, among others, the floating vapor hose 7, the buoy vapor piping 1'*b*, the subsea vapor hose 16 and the subsea vapor pipelines 17,27) from the vessel 5 towards the vapor processing facility 18.

For energizing the fan 42 there are a number of options. In a most common embodiment, the fan will be an electric fan, such that a member for energizing the fan will be configured as an electric cable 43 connected to a source of electric power.

In one embodiment the source of electric power is an onshore power source 44. But in alternative embodiments the source of electric power may be a buoy supported power source, such as at least one of, or any combination of, a solar panel 45, a battery 46, and a wind turbine 47 (or a tidal turbine or wave generator).

Figure 4:
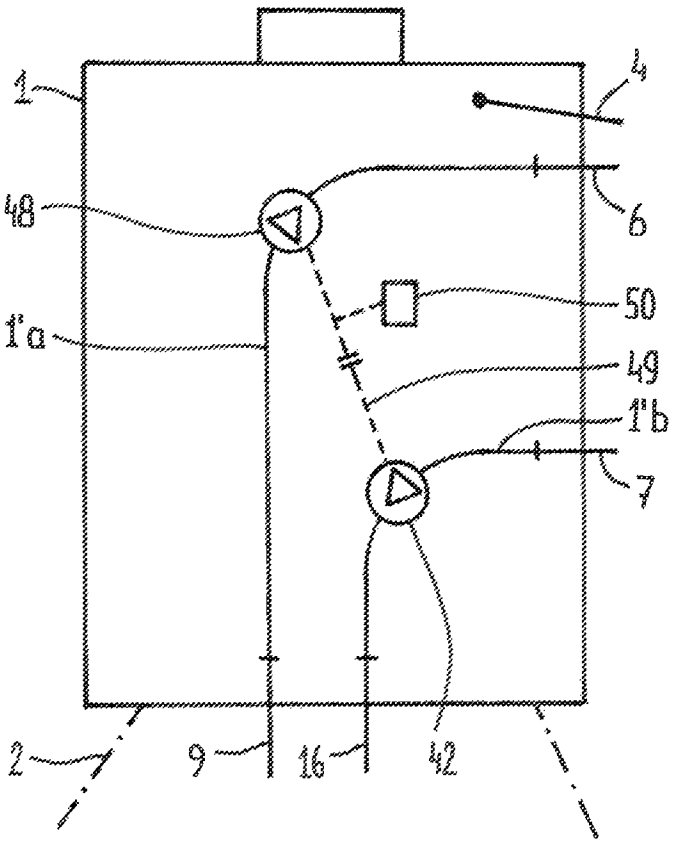

FIG. 4 shows an alternative embodiment of the buoy 1 of the system on a larger scale. As illustrated, the buoy vapor piping 1'*b* again is provided with the fan 42 configured to promote a flow of vapor through the components of the vapor return assembly from the vessel 5 towards the vapor processing facility 18. In this embodiment, a turbine (or pump) 48 is provided in the buoy oil piping 1'*a* which acts as a member for energizing the fan 42 and which is drivingly connected to the fan (as indicated schematically at 49).

The manner in which the turbine 48 is drivingly connected to the fan 42 may vary. Examples are a mechanical shaft, a hydraulic connection, a pneumatic connection or by means of an electric assembly comprising an electric generator connected to (or integrated into) the turbine 48 and an electric motor for driving the fan 42 (the electric motor also may be an integral part of the fan).

Although the FIGS. 3 and 4 illustrate embodiments of the system in which the fan 42 is provided in the buoy vapor piping 1'*b* and wherein the turbine 48, if present, is provided in the buoy oil piping 1'*a*, such a fan and/or turbine also may be provided in any other component defining the vapor return assembly (such as the floating vapor hose 7, the subsea vapor hose 16 and the subsea vapor pipelines 17,27) and in any other component defining an oil supply assembly (such as the floating oil hose 6, the subsea oil hose 9 and the subsea oil pipeline 11), respectively. Also, the number of fans and number of turbines may vary (such that more than one of these parts is provided).

A control member 50 may be provided controlling the manner in which the turbine 48 drives the fan 42. Such a control member 50 also may be part of the embodiment according to FIG. 3.

The invention is not limited to the embodiments described which may be varied widely within the scope of the invention as defined by the appending claims.

What is claimed is:

1. A system for transferring crude oil from an onshore location to an offshore vessel comprising:

a buoy;

a crude oil supply assembly comprising:

a buoy oil piping on the buoy;

at least one oil hose having a first oil hose end connected to the buoy oil piping and an opposite second oil hose end configured to be connected to the vessel; and at least one oil conduit assembly having a first oil conduit end configured to be connected to an onshore oil supply and an opposite second oil conduit end connected to the buoy oil piping, wherein the at least one oil conduit assembly comprises:

a subsea pipe-line end manifold (PLEM);

at least one subsea oil hose having a first sub-sea oil hose end connected to the PLEM and an opposite second subsea oil hose end defining the second oil conduit end connected to the buoy oil piping; and at least one subsea oil pipeline having a first subsea oil pipeline end defining the first oil conduit end configured to be connected to the onshore oil supply and a second subsea oil pipeline end supported by the PLEM and, directly or indirectly, connected to the first subsea oil hose end of the at least one subsea oil hose; and a vapor return assembly comprising:

a buoy vapor piping on the buoy;

at least one vapor hose having a first vapor hose end connected to the buoy vapor piping and an opposite second vapor hose end configured to be connected to the vessel;

at least one vapor conduit assembly having a first vapor conduit end configured to be connected to a vapor processing facility and an opposite second vapor conduit end connected to the buoy vapor piping;

an additional subsea pipe-line end manifold (PLEM);

at least one subsea vapor hose having a first subsea vapor hose end connected to the additional PLEM and an opposite second subsea vapor hose end defining the second vapor conduit end connected to the buoy vapor piping;

at least one subsea vapor pipeline having a first subsea vapor pipeline end defining the first vapor conduit end configured to be connected to the vapor processing facility and a second subsea vapor pipeline end supported by the additional PLEM and, directly or indirectly, connected to the first subsea vapor hose end of the at least one subsea vapor hose;

a fan configured to promote a flow of vapor through the vapor return assembly from the vessel towards the vapor processing facility; and a member configured to energize the fan.

2. The system according to claim 1, wherein the fan is provided in the buoy vapor piping.

3. The system according to claim 1, wherein the fan is an electric fan and wherein the member comprises an electric cable connected to a source of electric power.

4. The system according to claim 3, wherein the source of electric power is an onshore power source.

5. The system according to claim 3, wherein the source of electric power is a buoy supported power source.

6. The system according to claim 5, wherein the buoy supported power source is at least one of, or any combination of, a solar panel, a battery, and a wind turbine.

7. The system according to claim 1, wherein the member comprises a turbine provided in the crude oil supply assembly and drivingly connected to the fan.

8. The system according to claim 7, wherein the turbine is drivingly connected to the fan by one of a mechanical shaft, a hydraulic connection, a pneumatic connection or by an electric assembly comprising an electric generator connected to the turbine and an electric motor for driving the fan.

9. The system according to claim 8, wherein the electric generator is integrated into the turbine.

10. The system according to claim 7, wherein the turbine is provided in the buoy oil piping.

11. The system according to claim 1, wherein the oil hose is a floating oil hose and wherein the vapor hose is a floating vapor hose.

12. The system according to claim 1, wherein the PLEM and additional PLEM are combined into a single PLEM.

13. The system according to claim 1, and further comprising a drain operatively connected to at least one of the vapor hose, buoy vapor piping, subsea vapor hose and subsea vapor pipeline and configured to remove condensed vapor therefrom.

* * * * *